United States Patent [19]

Fan

[11] Patent Number: 4,911,676

[45] Date of Patent: Mar. 27, 1990

[54] MUSIC DOLL DRIVING MECHANISM

[76] Inventor: Te-An Fan, No. 191, Lane 301, Ta-Tu Road, Sec. 3,, Pei Tou, Taipei, Taiwan

[21] Appl. No.: 307,877

[22] Filed: Feb. 7, 1989

[51] Int. Cl.[4] ..... A63H 3/28; A63H 3/20; G09F 19/08

[52] U.S. Cl. ..... 446/300; 446/330; 40/419

[58] Field of Search ..... 446/300, 299, 298, 297, 446/330, 352, 353, 354, 355, 356, 376, 377; 40/418, 419, 417

[56] References Cited

U.S. PATENT DOCUMENTS

| | | | |
|---|---|---|---|
| 2,860,434 | 11/1958 | Kost et al. | 40/417 |
| 3,029,552 | 4/1962 | Katz | 446/353 |
| 3,331,463 | 7/1967 | Kramer | 446/353 X |
| 3,452,473 | 7/1969 | Convertine | 446/353 X |
| 3,564,763 | 2/1971 | Cleveland et al. | 446/355 |
| 3,583,098 | 6/1971 | Bear | 446/355 |
| 3,704,543 | 12/1972 | Giroud | 446/355 |
| 3,851,418 | 12/1974 | Barlow et al. | 446/354 X |
| 3,858,353 | 1/1975 | Glass et al. | 446/354 |
| 4,516,951 | 5/1985 | Saigo et al. | 446/353 X |

FOREIGN PATENT DOCUMENTS

| | | | |
|---|---|---|---|
| 61-21104 | 6/1986 | Japan | 446/354 |
| 662700 | 12/1951 | United Kingdom | 446/353 |
| 755334 | 8/1956 | United Kingdom | 446/297 |
| 2063691 | 6/1981 | United Kingdom | 446/300 |
| 2188851 | 10/1987 | United Kingdom | 446/353 |

*Primary Examiner*—Mickey Yu
*Assistant Examiner*—D. Neal Muir
*Attorney, Agent, or Firm*—Lowe, Price, LeBlanc Becker & Shur

[57] ABSTRACT

A music doll driving mechanism which includes a music box in the body with a driving gear mounted thereon as disclosed. The driving gear includes a top cover and a bottom cover to form a container for the component parts which includes a revolving disk, a cam link mounted on the revolving disk to drive a rocking plate thereon to make reciprocal movements so as to further drive two rocker arms which are connected to both ends of the rocking plate and are driven to displace one arm of the doll separately or both, concomitantly according to the preferred design. A vertical axle is mounted on the revolving disk at the bottom, its extension axle mounted in the eccentric hole of the revolving disk, with the top end being inserted into the bottom of the doll's head portion. By this arrangement, the head and extremities of the music doll are simultaneously driven while the music box is driven to provide music.

3 Claims, 6 Drawing Sheets

MUSIC DOLL DRIVING MECHANISM

BACKGROUND OF THE INVENTION

The present invention is related to a music doll driving mechanism. The revolvable driving disc is mounted on the driving shaft of the music box, which driving disc is further connected to a, cam link which is connected with the bottom stub axle of the rocking plate, such that the rocking plate follows the eccentric rotation of the driving disc to make a reciprocating movement. In the present invention, the rocking plate is pivotally connected with a rocker arm at both ends. Each rocker arm comprises a snap means to secure it to the doll's arm portion. When the rocking plate is driven, the connected two rocker arms are drive concomitantly or separately according to the method of assembly so as to cause one or both of the two arm portions of the doll to swing. There in provided a vertical axle mounted on the revolving disc at the bottom by means of its extension axle setting in the eccentric hole of the revolving disc, with the top end being inserted into the bottom of the doll's head portion. When the rocking plate is driven to displace, the vertical axle is simultaneously driven to rotate to further make the doll's head portion turn round. According to the above-described structure, a music doll is allowed to have its four extremities and its head to make a synchronous movement while music is provided by a music box in the doll.

SUMMARY OF THE INVENTION

The present invention is to provide a driving mechanism for music doll and, more particularly to a music doll which includes a music box in the body with a driving gear mounted thereon. The driving gear includes a top cover and a bottom cover to form a container for setting therein the component parts which include a revolving disc, a cam link mounted on said revolving disc to drive a rocking plate thereon to make reciprocating movement so as to further drive two rocker arms to swing, which two said rocker arms are connected to both ends of said rocking plate and are driven to displace separately or concomitantly according to the preferred design, a vertical axle mounted on the revolving disc at the bottom by means of its extension axle setting in the eccentric hole of the revolving disc, with the top end being inserted into the bottom of the doll's head portion. By means of said arrangement, the head and the four extremities of the music doll are simultaneously driven to move while music box is driven to provide a music.

DETAILED DESCRIPTION OF THE PREFERRED EMBODIMENTS

Figure 1:
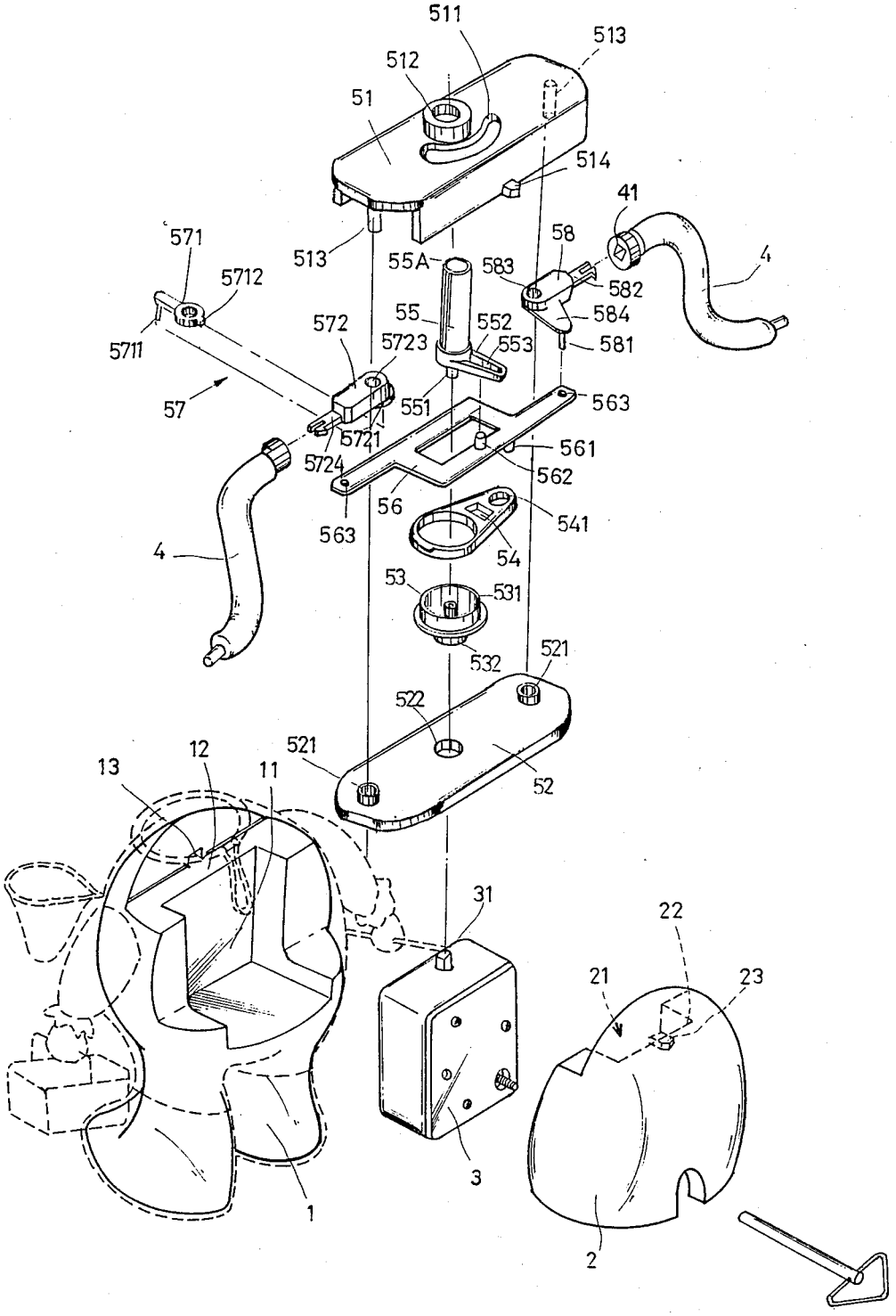
FIG. 1 is an exploded perspective view of the present invention, illustrating the shape of every component part or member of the whole assembly.

Referring to FIG. 1, a music doll of the present invention includes a body (1) comprising a hollow chamber (11), and a notch (12) transversely disposed at the top, to vertically communicate with said hollow chamber (11). A back body portion (2) is provided to match with said body (1), which comprises a hollow chamber (21) to communicate with an upper notch (22). A further notch (13) or (23) is made on the top of said notch (12) or (22) for insertion therein of the respective tab (514) of a top cover (51) to retain the driving mechanism firmly in said slots (12) and (22). (This part will be described further).

The hollow chambers (11) and (12) of the front body (1) and the back body (2) are for receiving a music box (3), while the transverse slots (12) and (22) are for receiving a driving mechanism. The said driving mechanism includes a top cover (51) and a bottom cover (52) incorporated to form a container for setting of driving mechanism assemblies including a revolving disc (53) mounted on the driving shaft (31) of said music box (3). An oscillating cam link (54) is mounted on said revolving disc (53), and a vertical axle (55) is mounted on said revolving disc (53) by means of its extension axle (551) setting in the eccentric hole (531) of said revolving disc (53). The revolving disc mounts a tube-like sleeve (532), which is eccentrically mounted at the bottom of said revolving disc (53) and extends through the central hole (522) of said bottom cover (52) and connects to said driving shaft (31). When said driving shaft (31) rotates, said revolving disc (53) is driven eccentrically and said link (54) is simultaneously driven to oscillate. Link (54) has a hole at an end for receiving bottom stub axle (561) on rocking plate (56). When said revolving disc (53) is revolving, said link (54) will drive said rocking plate (56) to make a left-right reciprocating movement.

Figure 6:
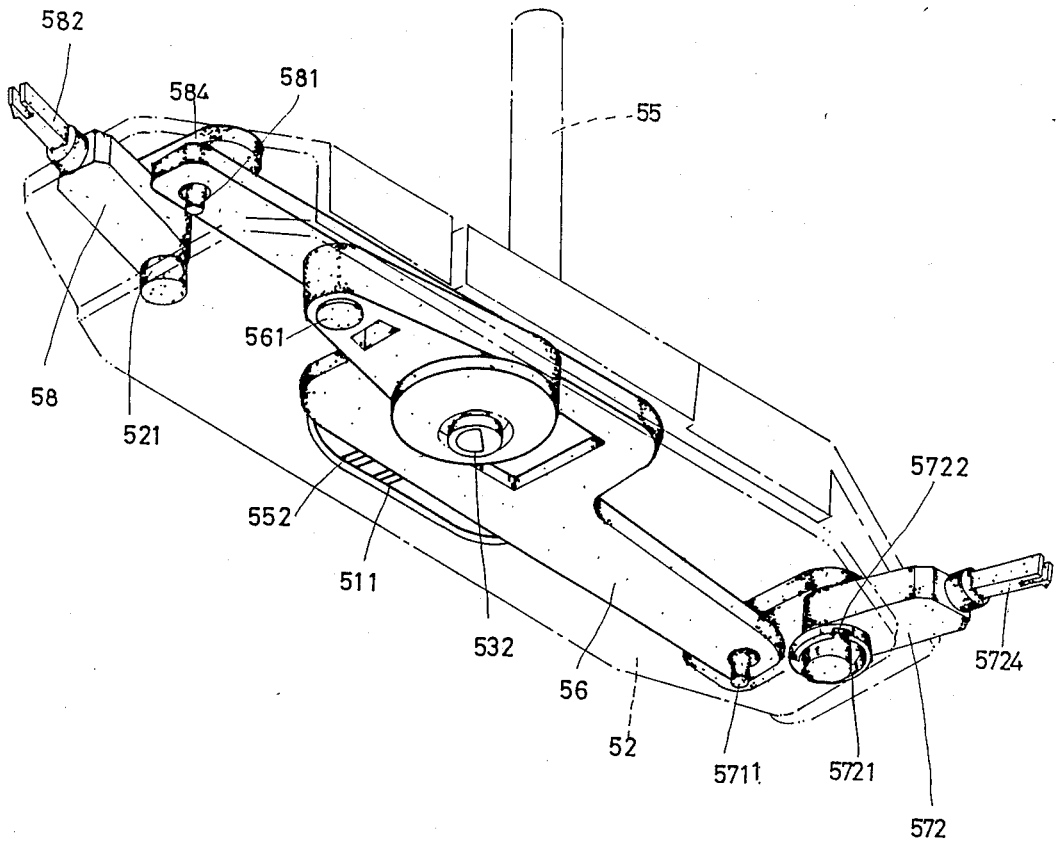
FIG. 6 is a schematic drawing of another embodiment of the present invention.

The said rocking plate (56) comprises two holes (563) at either end, with the first hole (563) been connected with a left rocker arm (57) by means of the drive tip (5711) on the link rod (571) of the left rocker arm (57), and with the second hole (563) connected with a right rocker arm (58) by means of the drive tip (581) of the right rocker arm (58). When said rocking plate (56) is driven to make a left-right reciprocating movement, said left and right rocker arms (57) and (58) are driven to swing. The said two rocker arms (57) and (58) each comprises a snap means (5724) or (582) to be received in rectangular hole (41) of a doll arm frame portion (4) to drive respective doll arm frame portion (4) to follow the associated rocker arm (57) or (58) to swing. The said left rocker arm (57) comprises a link rod (571) and an extension rod (572). When the ring portion of the said link rod (571) is set in the flange (5721) of the extension rod (572), the notch (5722) of the flange (5721) is connected with the nose (5712) of the said link rod (571). See FIG. 6. At this moment, the said extension rod (572) and the said link rod (571) are simultaneously driven by the said rocking plate (56) to displace. By means of this arrangement, the said left rocker arm (57) and the said right rocker arm (58) are concomitantly driven to swing. In addition to concomitant displacement of the said two rocker arms (57) and (58) driven by the said rocking plate (56) to let the two arm portions of the doll swing, the said left rocker arm (57) may be turned to let the nose (5712) of its link rod (571) break away from the notch (5722) of the extension rod (572) so as to let the extension rod (572) be turned upside down and to let the extension rod (572) and the link rod (571) be disposed in opposition to each other. At this moment, the said extension rod (572) is free from the driving of the said link rod (571) and the said rocking plate (56). Therefore, when the said rocking plate (56) is driven, the said right rocker arm (58) is driven to swing, and the left rocker arm (57) remains immovable. By means of this arrangement, the doll may be set, according to requirement, to swing one or both of its two arms.

The said rocking plate (56) is a rectangular frame having two elongated rods symmetrically disposed at both ends in parallel with each other, and an upwardly disposed stub axle (562) to insert in the elongated slot (553) of the extension plate (552) at the bottom of said vertical axle (55). When said rocking plate (56) is driven, by said extension plate (552), said vertical axle oscillates about its vertical axis. Further, said vertical axle (55) comprises a conical top end. When a doll head portion is mounted on said vertical axle (55), the mounted doll head portion will be driven to turn when said axle turns.

The said top cover (51) defines an arc-shaped slot (511). While in assembly, said upper stub axle (562) of said rocking plate is arranged to protrude through said arc-shaped slot (511) and to displace therealong. Said top cover (51) also comprises a raised block (512) having an axle hole for insertion therethrough of said vertical axle (55) to confine said vertical axle (55) axially.

Figure 2:
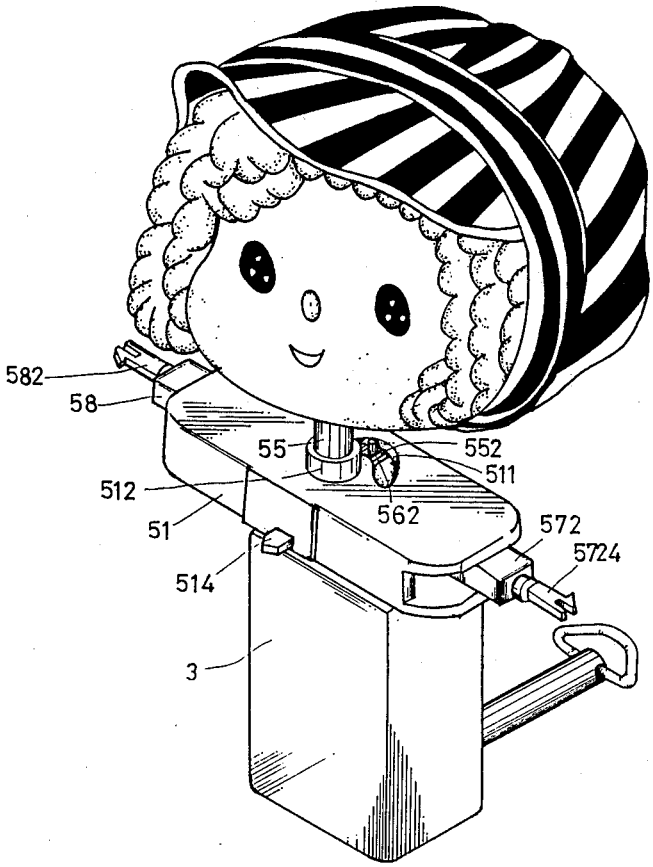
FIG. 2 is a perspective schematic view, illustrating the relationship of the driving mechanism with the music box, showing the configuration of the doll's head.
Figure 3:
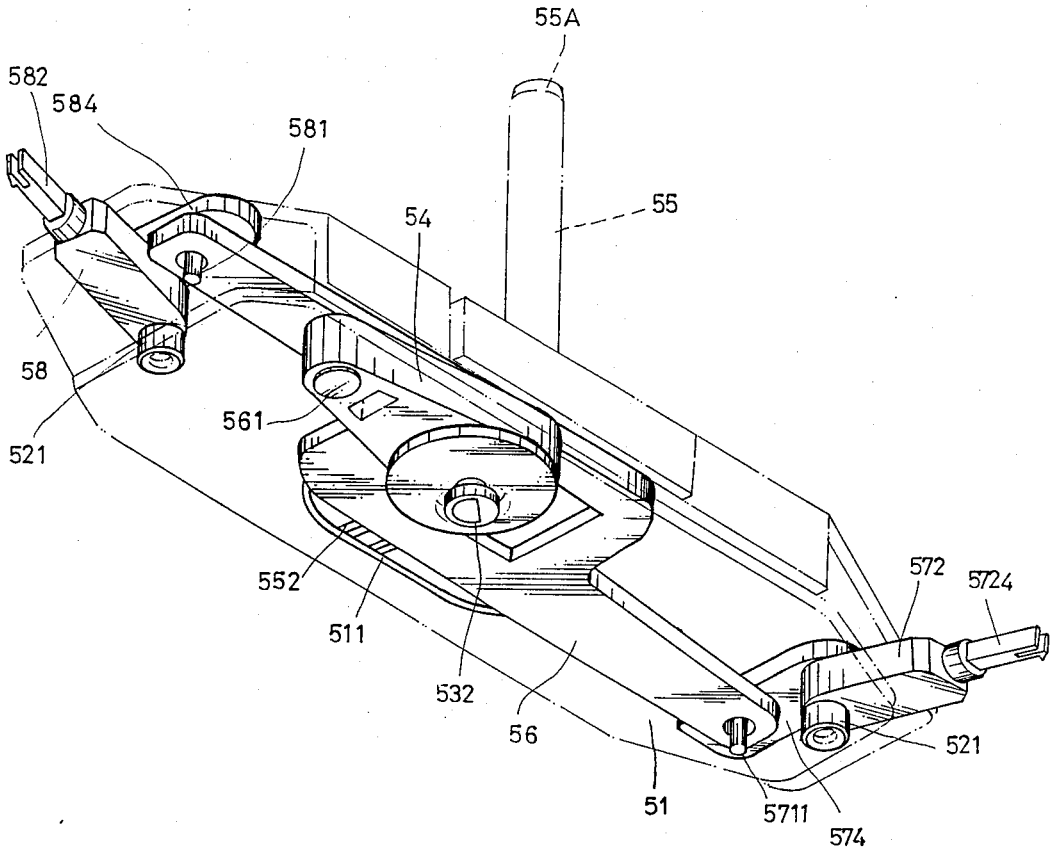
FIG. 3 is a structural schematic view of the driving mechanism, illustrating the coupling of its component parts.

The said top cover (51) also comprises two symmetrically disposed bottom stub axles (513) for insertion into holes (5723) and (583) of said rocker arms (57) and (58) respectively to further insert into the axial hole of the raised two blocks (521) of said bottom cover (52) so as to have the whole assembly of the driving mechanism firmly attached (As shown in FIGS. 2 and 3).

The said top cover (51) has a circularly chamfered edge at both ends such that said two rocker arms (57) and (58) do not contact the side frame during rocking. The said bottom cover (52) has also a chamfered edge at both ends. Further, said top cover (51) also comprises two tabs (514) horizontally disposed at the center of the front side edge and the center of the back side edge respectively to be inserted into the notches (13) and (23) of said front body (1) and back body (2) respectively to let the whole assembly of the driving mechanism be firmly secured in said two slots (12) and (22) of said front and back bodies (1) and (2).

Please refer to FIG. 3, which illustrates the coupling of the said component parts of the driving mechanism, wherein said vertical axle (55) has a top notch (55A) for connection with a doll's head portion, and the other end of said vertical axle (55) is inserted into said top cover (51).

As shown in FIG. 3, said link (54) does not rotate with said revolving disc (53) link (54) is mounted on said revolving disc (53) through sleeve joint and is not fixed thereto. When said revolving disc (53) is making an eccentric movement, said link (54) follows said revolving disc (53) to make a forward and backward oscillating movement to further drive said rocking plate (56) to a reciprocating movement.

Figure 4:
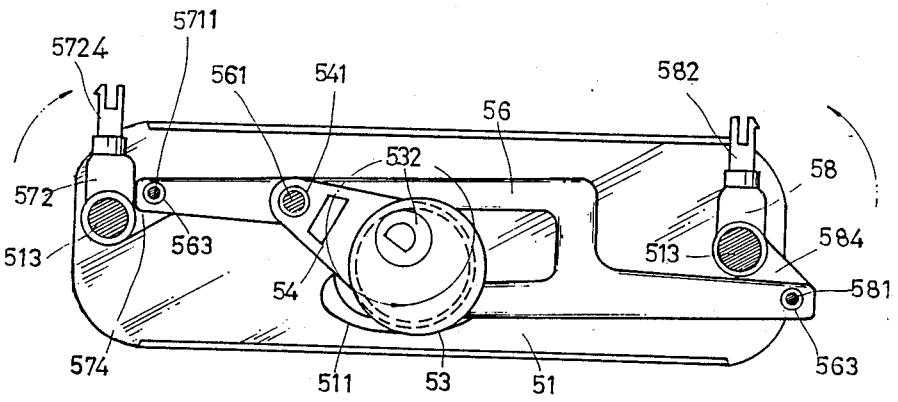
FIG. 4 is a schematic view, illustrating the rocker arms driven to point toward the front.
Figure 5:
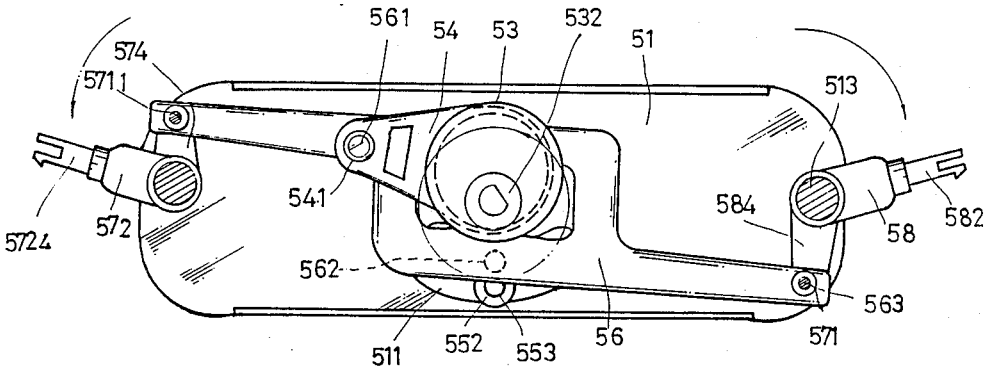
FIG. 5 is a schematic view, illustrating the rocker arms driven to a lateral position.

Further, said rocker arms (57) and (58) each comprises a laterally disposed extension arm (5713) or (584) opposite to the extension arm (584) or (574) of the other rocker arm. When said extension arm (5713) of the said link rod (571) of said left rocker arm (57) is arranged to extend forward, said extension arm (584) of said rocker arm (58) is arranged to extend backward, such that a close coordination between said two rocker arms (57) and (58) is obtained. Referring to FIGS. 4 and 5, while said revolving disc (53) is driven to rotate, said link (54) is driven to oscillate to further drive said rocking plate to make same reciprocating displacement. In FIG. 4, the two rocker arms (57) and (58) are driven to point toward front side. In FIG. 5, the two rocker arms (57) and (58) are driven to point laterally. In general, as described above, the present invention provides a driving mechanism for a music doll to allow the four extremities and the head of the incorporated music doll to make a synchronous movement while a music is provided by a music box in the doll.

What is claimed:

1. A music doll, including:

a front body, comprising a first hollow chamber, and a first notch transversely disposed at a top surface to communicate with said first hollow chamber;

a back body comprising a second hollow chamber, and a second notch transversely disposed at a top surface to communicate with said second hollow chamber;

a music box set in said first and second hollow chambers, said box having a driving shaft;

a driving mechanism set in said first and second slots; said driving mechanism comprising: a top cover having a laterally extending front edge and a back edge and a bottom cover to form a container said bottom cover defining a central hole aligned with the driving shaft;

a revolving disc having a tube-like sleeve at a bottom extending through the central hole of said bottom cover said sleeve coupled to said driving shaft; a cam link mounted on said revolving disc, having a cam hole at one end; a rocking plate comprising a bottom stub axle received in a second hole in said cam link and an upper stub axle said plate having a rocker arm drive hole at each end; a left rocker arm having a drive tip received in one rocker arm drive hole in said rocking plate, and a right rocker arm having a second drive tip said second drive tip received in the other of said rocker arm drive holes in said rocking plate; a snap means connecting a doll's arms portion to each of said rocker arms; a vertical axle mounted on said top cover with the top end of said vertical axle inserted into a bottom of a head portion member of said doll said top cover having two horizontally disposed tabs on a front side edge and a back side edge respectively inserted into the notches of said front body and back body respectively to let the whole assembly of the driving mechanism be firmly secured in said hollow chambers by said notches of said front and back bodies.

2. The music doll of claim 1, wherein said top cover comprises a raised block having an axle hole for insertion therethrough of said vertical axle, and an arc-shaped slot adjacent said raised block to receive said upper stub axle of said rocking plate.

3. The music doll of claim 1, wherein said rocking plate is a rectangular frame having two elongated rods symmetrically disposed at opposite ends in parallel to each other.

* * * * *